US008082944B2

(12) United States Patent
Rosine et al.

(10) Patent No.: US 8,082,944 B2
(45) Date of Patent: Dec. 27, 2011

(54) PIVOTAL BASE FOR ENCLOSED HOSE REEL

(75) Inventors: Lyle A. Rosine, Oswego, IL (US); Torrence C. Anderson, Overland Park, KS (US); Robert Stein, Aurora, IL (US)

(73) Assignee: Suncast Corporation, Batavia, IL (US)

( * ) Notice: Subject to any disclaimer, the term of this patent is extended or adjusted under 35 U.S.C. 154(b) by 402 days.

(21) Appl. No.: 11/673,921

(22) Filed: Feb. 12, 2007

(65) Prior Publication Data

US 2007/0187543 A1 Aug. 16, 2007

Related U.S. Application Data

(63) Continuation-in-part of application No. 11/219,055, filed on Sep. 1, 2005, now Pat. No. 7,360,748.

(51) Int. Cl.
*B65H 75/34* (2006.01)

(52) U.S. Cl. ..... 137/355.26; 137/355.16; 137/377

(58) Field of Classification Search ..... 137/355.26, 137/355.22, 355.27, 377, 355.16, 355.28; 248/349.1; 242/406, 403; 220/4.16, 4.33
See application file for complete search history.

(56) References Cited

U.S. PATENT DOCUMENTS 1,532,177 A * 4/1925 Gist ..... 248/89
1,933,163 A * 10/1933 Coplen ..... 242/404
2,779,642 A 1/1957 Matthews
2,871,057 A * 1/1959 Bernyk ..... 248/89
2,902,161 A * 9/1959 Humbert, Jr. et al. ..... 210/416.5
4,659,050 A 4/1987 Tabayashi
4,697,778 A 10/1987 Harashima
4,757,838 A 7/1988 McGullion
4,793,376 A 12/1988 Hare
4,946,127 A 8/1990 Kulaga
5,000,513 A 3/1991 Schmidt
5,080,322 A 1/1992 Harley
5,109,882 A 5/1992 Eley
5,179,972 A 1/1993 Eley
5,404,900 A 4/1995 Fletchall
5,462,298 A 10/1995 Bodine
5,779,309 A 7/1998 Lu
6,050,291 A 4/2000 Whitehead et al.
6,467,499 B1 10/2002 Smith
6,478,265 B2 11/2002 Leach
6,546,953 B1 * 4/2003 Kowalke ..... 137/355.16
(Continued)

*Primary Examiner* — John Rivell
*Assistant Examiner* — Macade Brown
(74) *Attorney, Agent, or Firm* — McHale & Slavin, P.A.

(57) ABSTRACT

A base assembly, including wheels, is attachable to the bottom of a hose reel enclosure. This assembly enables the hose reel enclosure to pivot about a vertical axis. This pivotal movement of the hose reel enclosure permits a hose to be withdrawn from and wound back onto the hose reel in the enclosure while remaining substantially perpendicular to the longitudinal axis of the hose reel. This also enables a hose to be taken up evenly onto the hose reel and played out from the hose reel without tipping over the hose reel enclosure. In one embodiment, the base assembly is attached to the bottom of a hose reel enclosure. Two wheels are mounted at one end portion of the assembly and a stake is positioned in a member mounted between the end portions of the base assembly. The stake is driven into the ground below the hose reel enclosure. The wheels enable the hose reel enclosure to be pivoted along the ground about the stake to enable a hose to be evenly taken up onto the hose reel and played out from the hose reel without tipping the hose reel enclosure over. In another embodiment, the wheels and stake are mounted directly onto the hose reel enclosure.

15 Claims, 6 Drawing Sheets

U.S. PATENT DOCUMENTS

| | | | | |
|---|---|---|---|---|
| 6,742,740 | B2 | 6/2004 | Tisbo et al. | |
| 6,807,982 | B1 | 10/2004 | Ames | |
| 6,877,687 | B2 | 4/2005 | Moon et al. | |
| 7,032,811 | B1 | 4/2006 | Paulic et al. | |
| 2003/0234312 | A1* | 12/2003 | Kuo | 242/395 |
| 2004/0178314 | A1 | 9/2004 | Chen et al. | |
| 2006/0054770 | A1 | 3/2006 | Lansdown | |
| 2007/0018026 | A1* | 1/2007 | Uffner et al. | 242/395 |
| 2007/0125778 | A1* | 6/2007 | Uffner et al. | 220/4.28 |

* cited by examiner

PIVOTAL BASE FOR ENCLOSED HOSE REEL

CROSS-REFERENCE TO RELATED APPLICATIONS

This application is a continuation in part of U.S. patent application Ser. No. 11/219,055, filed on Sep. 1, 2005 now U.S. Pat. No. 7,360,748 and entitled Rotary Table For Enclosed Hose Reel, the contents of which are incorporated herein by reference.

FIELD OF THE INVENTION

This invention pertains to reels used for the storage of flexible hoses and more particularly, to a hose reel enclosure having wheels pivotally mounted on a front portion of the enclosure and a spike or rod attached to a central or rear portion of the enclosure. The spike or rod can be driven into the ground. The hose reel enclosure can pivot about the stake or rod.

BACKGROUND OF THE INVENTION

Portable hose reel dispensers for storage and dispensing of flexible water hoses, such as garden and air hoses, have gained wide public acceptance. While the construction of hose reels is quite varied, such reels are primarily constructed of molded plastic components having a centrally disposed retractable spool for reeling in and playing out of the flexible hose and a frame for supporting the spool. Recently there has been recognized a need for aesthetically pleasing hose reel storage devices. This need has been satisfied by the development of an enclosure for a hose mounted on a reel. These hose reel enclosures are located adjacent a water spigot and hide the unsightly garden hose from view.

Usually there are only a few water spigots positioned along the outside perimeter of the house. In order to provide water to all the portions of the yard which require watering, the garden hose must be extended in all directions from the spigot from one side thereof to the complete opposite side thereof. This presents a problem when the garden hose is stored in a hose reel enclosure. A garden hose is more readily played-out from and rewound back onto the reel when the garden hose extends substantially perpendicularly from the front panel than when it extends at a substantial angle to the front panel.

What is needed in the art is an enclosed hose reel capable of playing-out and rewinding a garden hose in a direction substantially perpendicularly to the front panel of the enclosure. The enclosure should be capable of permitting a hose to be played-out from and rewound onto a reel without placing undue sideways strain on the hose reel. The enclosure should be able to adapt to the hose being moved across the yard and changing angles with respect to the front panel of the enclosure.

DESCRIPTION OF THE PRIOR ART

U.S. Pat. No. 6,050,291 discloses an enclosed hose reel for use with a flexible hose. The hose reel includes a spool around which a flexible hose is wound. The spool is configured for storage, take up and pay out of the hose. The top, front, rear and side panels are formed into aesthetically pleasing shapes. These panels are assembled together forming an enclosure which hides the hose and hose reel from a person's view. Whenever someone wants to use the hose, they raise the top of the enclosure thereby gaining access to the hose. When the hose is in use it can extend out of the enclosure through the opening 54 in the top portion of the front panel of the enclosure. This allows a person to use the portion of the hose which is outside of the enclosure while the remainder of the hose remains neatly stored with in the enclosure on the spool. The enclosure must be lifted off of the ground if someone wishes to turn the front of the enclosure so as to permit easier access to the hose.

U.S. Pat. No. 6,877,687 discloses an enclosed hose reel for use with an associated flexible hose. The hose is stored on an enclosed reel from which it can be played out for use or wound up upon for storage when not in use. A battery powered electric motor is used to rewind the hose onto the reel for storage. The hose reel enclosure includes a top, front, rear, left and right side panels. The enclosure also has an open base. Again, the entire enclosure must be lifted off of the ground if someone wishes to turn the front of the enclosure so as to permit easier access to the hose.

U.S. Pat. No. 6,467,499 discloses an enclosed hose reel which includes a hose wound upon a reel mounted on a wall. An aesthetically pleasing cover 20 is hingedly connected to the wall to cover the hose when it is not in use. The cover must be completely removed prior to using the hose. The hose reel is mounted on a wall of a building and cannot be readily relocated.

These patents fail to teach or disclose a base assembly which can be attached to a hose reel enclosure in accordance with the present invention. What is lacking in the art is a hose reel enclosure which is can be pivoted about an axis so that the hose may be dispensed in various horizontal directions without tipping over the enclosure. Also, when the hose is wound back onto the reel the pivoting base prevents the hose from rolling up onto one side of the reel leaving the other side empty and placing an undue strain on one side of the hose reel.

SUMMARY OF THE INVENTION

Among the several aspects and features of the present invention may be noted the provision of a base assembly, including wheels, which is attached to the bottom of a hose reel enclosure. This enables the enclosure to pivot about a vertical axis. This pivotal movement of the hose reel enclosure permits a hose to be withdrawn from and wound back onto the hose reel in the enclosure while remaining substantially perpendicular to the longitudinal axis of the hose reel. This also enables a hose to be taken up evenly onto the hose reel and played out from the hose reel without tipping over the hose reel enclosure.

In one embodiment, a base assembly is attached to the bottom of a hose reel enclosure. Two wheels are mounted at one end portion of the assembly and a stake is positioned in a member mounted between the end portions of on the base assembly. The stake is driven into the ground below the hose reel enclosure. The wheels enable the hose reel enclosure to be pivoted along the ground about the stake to enable a hose to be evenly taken up onto the hose reel and played out from the hose reel without tipping the hose reel enclosure over. In another embodiment, the wheels and stake are mounted directly onto the hose reel enclosure.

Accordingly, it is an objective of the instant invention to provide a base assembly which permits a hose reel enclosure to pivot about a point.

It is a further objective of the instant invention to allow a hose reel enclosure to move so as to allow a hose to be taken up and played out without upsetting the hose reel enclosure.

It is yet another objective of the instant invention to provide a base assembly that can be readily attached to a hose reel enclosure without the use of tools.

It is a still further objective of the invention to provide an assembly for a hose reel enclosure which includes a rod like member attachable to a hose reel enclosure and insertable into the ground about which the hose reel enclosure can pivot.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
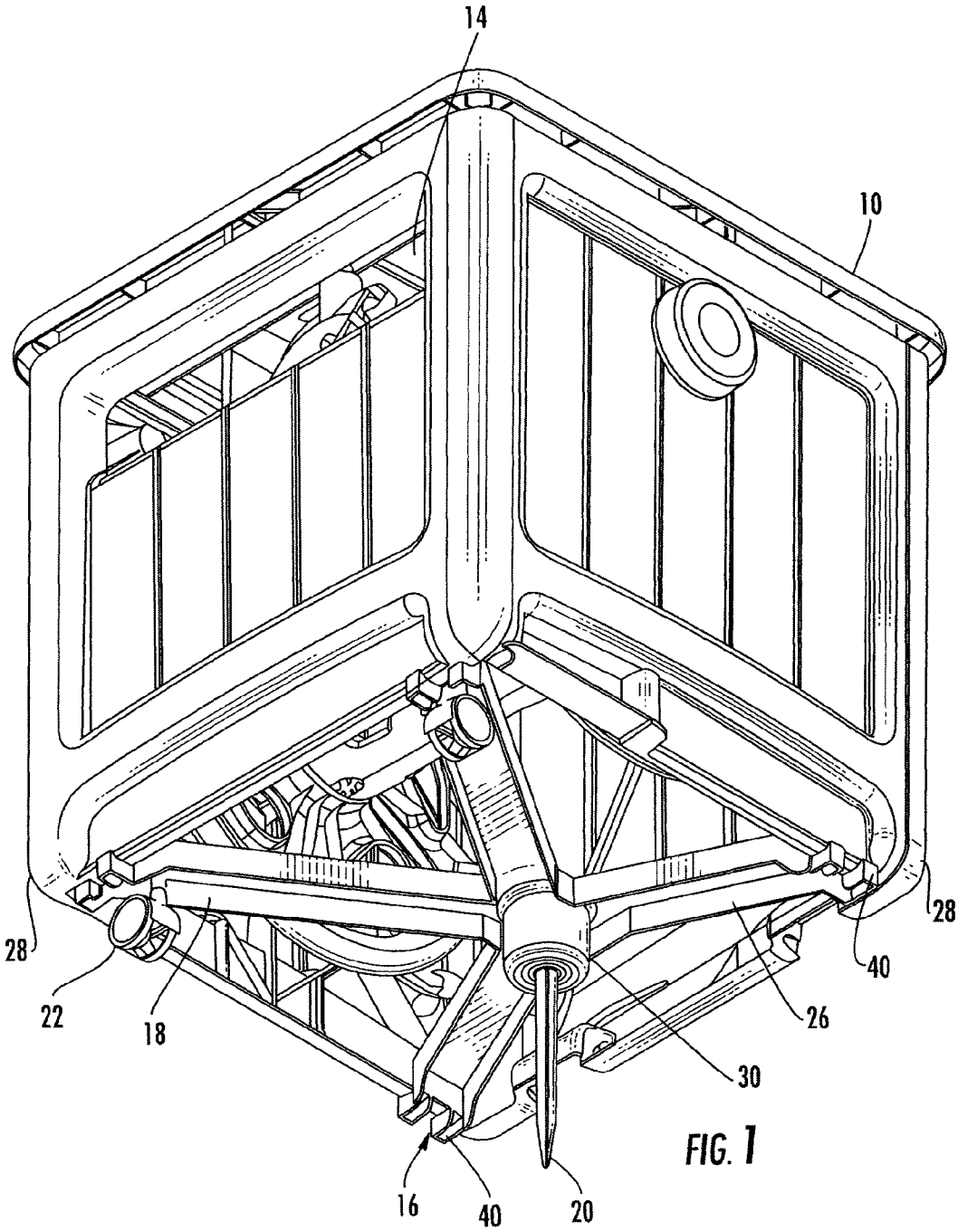
FIG. 1 is a bottom perspective view of a first embodiment of the present invention attached to a hose reel enclosure.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 5:
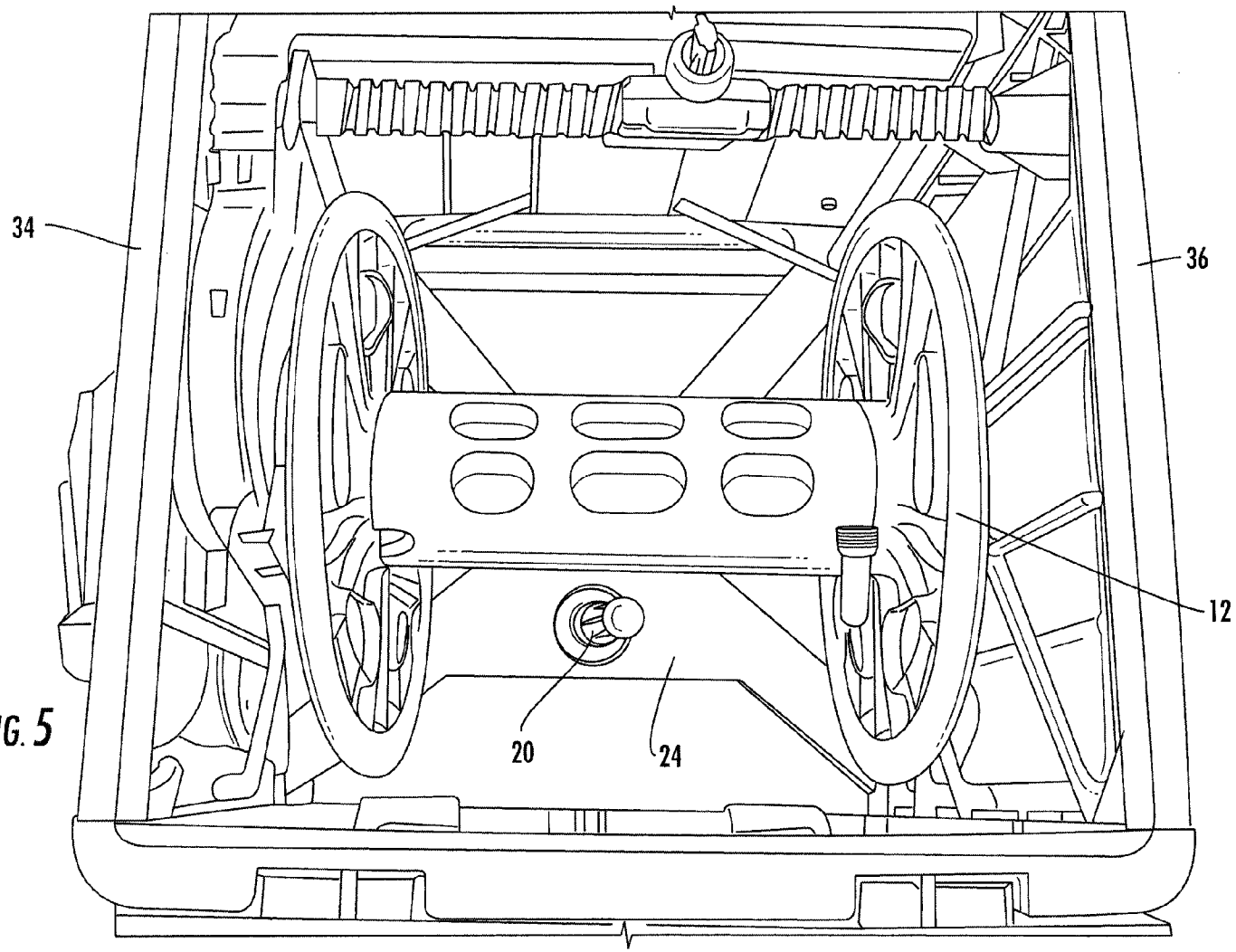
FIG. 5 is a bottom perspective view of a third embodiment of the present invention and FIG. 6 is a rear view of the third embodiment of the present invention.

Referring now to FIGS. 1, 2, 5 and 6 there is shown a hose reel enclosure 10. Positioned inside of the hose reel enclosure, a hose reel 12 is rotatably mounted to both interior side walls of the enclosure as seen in FIG. 5. A hose, not shown, is wound upon and stored on the reel 12 when not in use. Whenever a user desires to use the hose it must first be removed from the reel. This is done by unwinding the hose from the reel and removing it from the interior of the hose enclosure through opening 14 in the front panel. As the hose is played off the reel it moves from side to side in the opening 14. This is as a result of the hose being wound onto the reel in layers or rows which extend from one side of the reel to the other side and back again. Whenever the hose reaches one end of the slot 14 it presses against an end wall of the slot resulting in a side force which is exerted on the enclosure. This side force normally results in the enclosure tipping over sideways.

Figure 4:
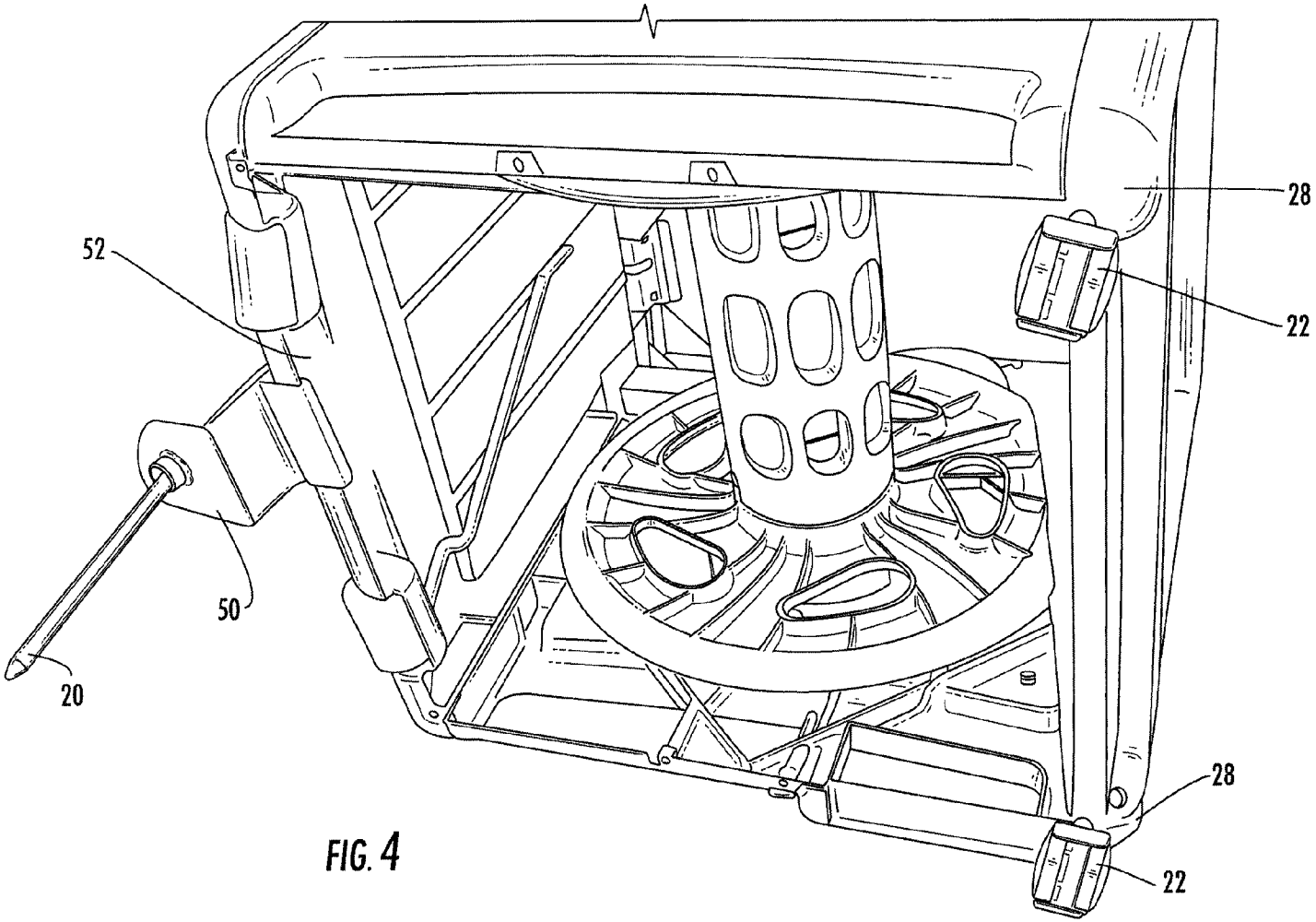
FIG. 4 is a bottom perspective view of a second embodiment of the present invention.

The present invention permits the enclosure to pivot about a vertical axis and thus allows the hose to remain in a center portion of the slot 14, as the hose is played out. This prevents the hose from moving to one end of the slot and exerting a force against an end of the slot 14 which would result in the enclosure tipping over. The hose enclosure is able to pivot about a vertical axis which is positioned along a centerline of the hose enclosure separating the right half from the left half, as illustrated in FIGS. 1 and 4. The pivot is a stake or rod pivotally mounted to the hose enclosure and driven into the ground. The pivotal mounting of the hose enclosure enables it to pivot clockwise or counterclockwise depending on the direction of the force exerted on the enclosure. For example, if the hose were exerting a force on the right end portion of the slot 14 the hose enclosure would pivot counterclockwise and if the hose were exerting a force of the left end portion of the slot 14 the hose enclosure would pivot clockwise.

Figure 2:
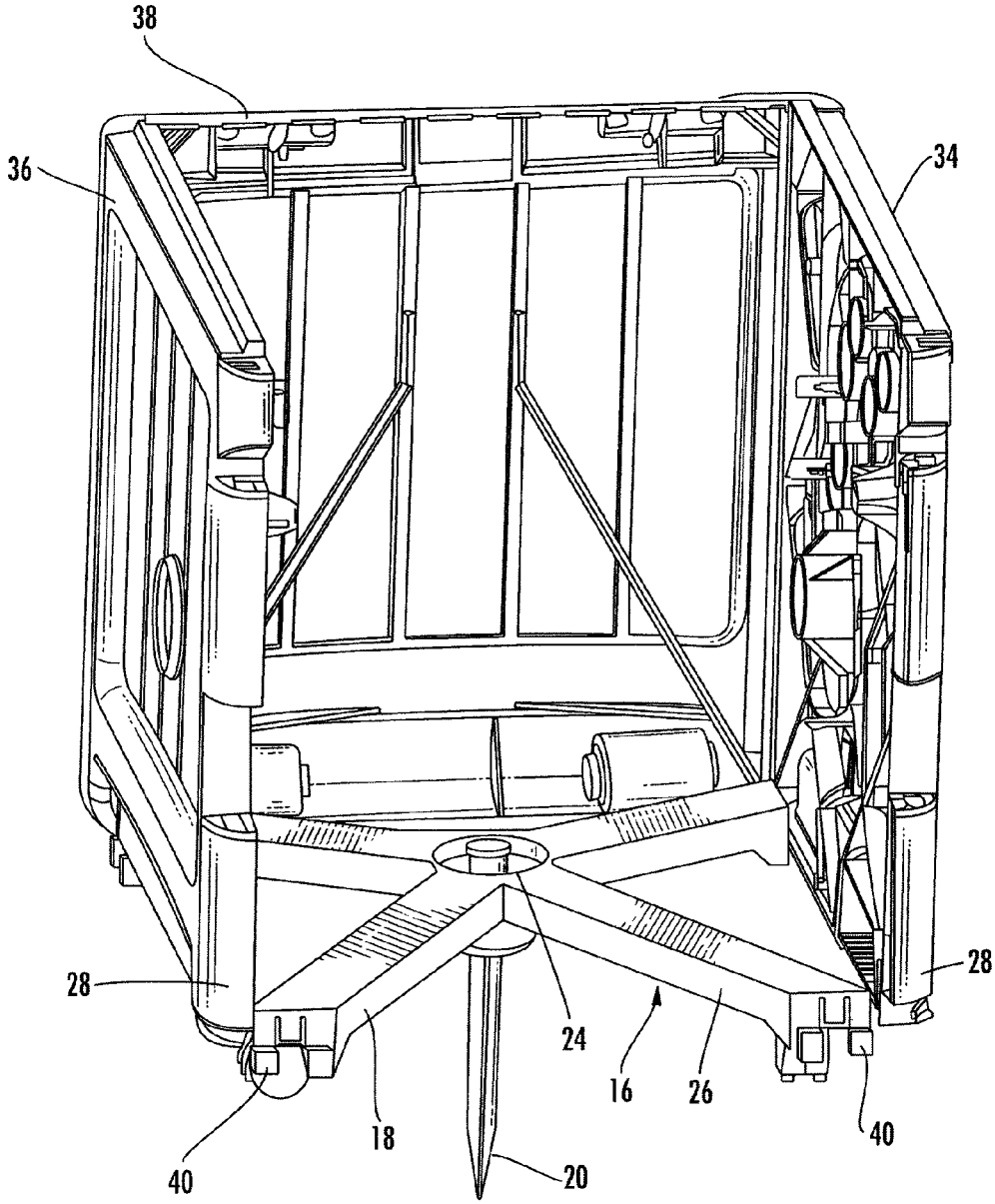
FIG. 2 is a top view, through the hose reel enclosure, of the first embodiment of the invention.

In a first embodiment of the present invention a base assembly 16 is mounted to a lower portion of a hose reel enclosure 10 as illustrated in FIGS. 1 and 2. The base assembly comprises a support frame member 18, a stake or rod 20, and a plurality of wheels 22. The support frame member 18 includes a central portion 24 and a plurality of extension members 26. In this non-limiting embodiment, there are four extension members 26 which extend radially outwardly from the central portion or area 24 toward the corners 28 of the hose reel enclosure 10 in the general form of a "X". The extension members are channel shaped in cross section in the illustrated embodiment, however they could have various different cross sectional shapes also. The number of extension members 26 could vary from one to an infinite number. The extension members can also be different elements and different shapes for example they could be flat, round, triangular, hexagonal or any other shape in cross section. They could be solid, hollow or partially filled elements. They could also be made from a single material or a composite of different materials. The support frame member could also be formed from a single piece of material that substantially covers the lower portion of the hose reel enclosure. In another embodiment, illustrated in FIG. 6, the central portion 24 is larger than the central portion of FIGS. 1 and 2.

A mounting assembly 30 is provided for connecting the stake, rod or securing element to the support frame 18. The mounting assembly is preferably located in the central portion 24 of the mounting assembly, but could also be located in other areas. In the embodiment illustrated in FIGS. 1 and 2 the mounting assembly comprises a substantially cylindrical housing in which a stake or securing element 20 is pivotally mounted. Any conventional means could be employed to pivotally mount the stake in the housing. While the housing is illustrated as being cylindrical, any other shape could be employed. The mounting assembly is preferably located along a center line that divides the hose reel enclosure into a right side 34 and a left side 36 (FIG. 2). It is also preferably mounted toward a rear side wall 38 of the hose reel enclosure. While this is the preferable mounting location, any other location within the lower horizontal portion of the hose reel enclosure would be operable.

Figure 6:
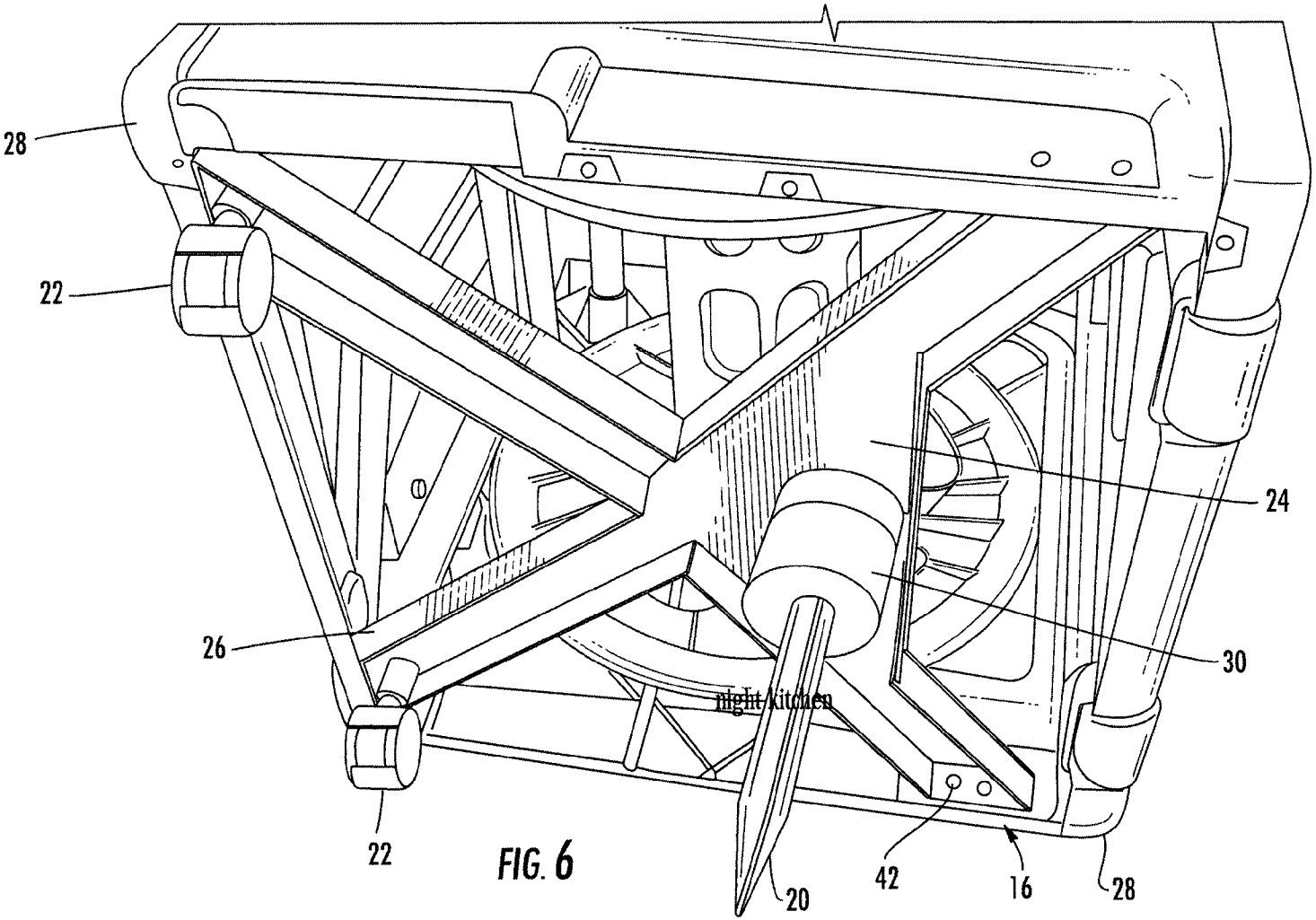

Wheels 22 are attached to the end portions of extension members 26 as illustrated in FIGS. 1, 2 and 6. In the illustrated embodiments they are caster wheels pivotally mounted on the extension members. Other types of wheels could also be employed. In addition, a ball housed in a socket could also be utilized. The only requirements of the wheels are that they provide support for the hose reel enclosure above the ground and permit it to pivot about the stake, rod or securing element 20. The wheels and the securing element support the hose reel enclosure above the ground or underlying surface.

The support frame 18 is attached to the lower portion of the hose reel enclosure with clips 40 in the embodiment illustrated in FIGS. 1 and 2. The clips are preferably flexible so that they can be deformed thereby securing the support frame to the lower edges of the hose reel enclosure. They can also be deformed to allow removal of the support frame from the enclosure. The clips may be integrally formed with the extension members 26 or they may formed as a separate element. In the embodiment illustrated in FIG. 6, the support frame is attached to the lower portion of the hose reel enclosure with conventional fasteners 42.

The element 20 about which the hose reel enclosure pivots is illustrated as a stake in a preferred embodiment (FIGS. 1 and 2). A rod or any other element that can be secured to an underlying surface could also be utilized. Once a location for the hose reel enclosure is selected the stake or rod is driven into the ground or earth. This is normally in a portion of a yard surrounding a home. Different types of means to secure the hose reel enclosure to the ground could also be utilized. For example, the cylindrical housing 32 could be secured to a rod or pipe mounted in concrete or asphalt.

Figure 3:
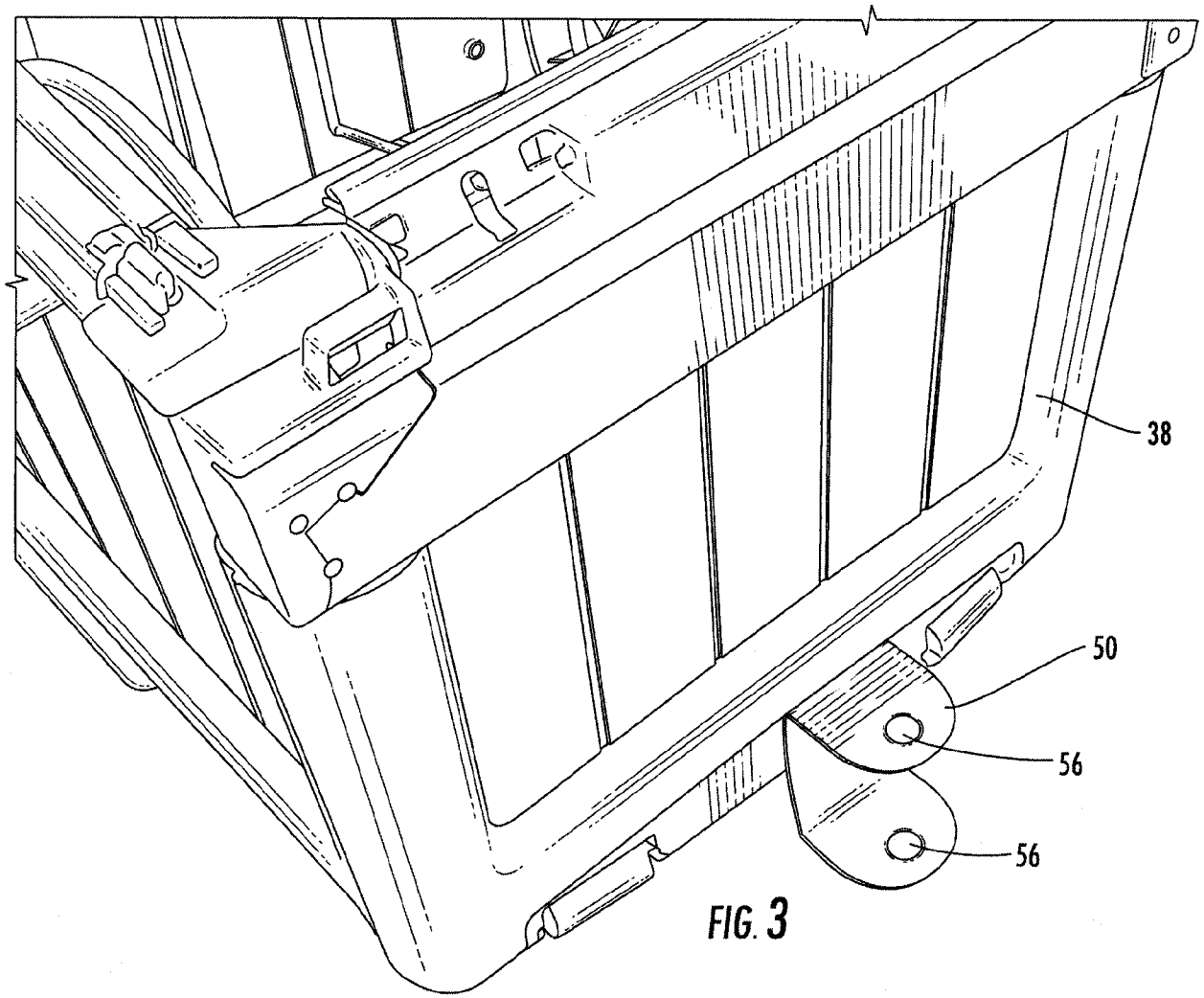
FIG. 3 is a front perspective view of a hose reel enclosure, with the front panel removed, of a second embodiment of the present invention.

Another embodiment is illustrated in FIGS. 3 and 4. A support member 50 is attached to a central portion of the lower portion of the rear side wall 38 of a hose reel enclosure. The support member is pivotally secured to a stake or securing element 20 which is driven into the ground or earth. In the illustrated embodiment the stake 20 is secured to the support member 50 by apertures 56. These apertures are larger in diameter than the stake or securing element 20. This permits the support member and hose reel enclosure to pivot about the stake. The stake or securing element can also be mounted to the support member utilizing bearings or other means which allow the support member to pivot about the stake or securing element. The support member could also be secured to a rod or pipe mounted in concrete or asphalt. A plurality of wheels 22 are mounted to the bottom of the corners 28 of the front side of the hose reel enclosure. In the illustrated embodiment they are caster wheels, but any other types of wheels could also be employed. In addition, a ball housed in a socket could also be employed. When a hose is played out from or wound onto the reel 12 and it exerts a force on the side of the opening 14 the support member 50 and wheels 22 allow the hose reel enclosure to pivot about stake or securing element 20 to prevent the enclosure from tipping over.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A base assembly for attachment to a hose reel enclosure to enable movement of the hose reel enclosure, said base assembly comprising;

a support frame member;

said support frame member being constructed and arranged to be attachable to a lower portion of a hose reel enclosure;

a mounting assembly mounted on said support frame member;

at least one wheel operatively connected to said support frame member adjacent an end portion thereof;

a securing element pivotally secured to said support frame member and being attachable to an underlying surface;

said mounting assembly is offset from the center of said support frame member in a direction toward a rear portion of said support frame member and said at least one wheel is located adjacent a front portion of said support frame member; and said at least one wheel and said securing element supporting said base assembly and said hose reel enclosure above an underlying surface, said base assembly and said hose reel enclosure pivotally move about said securing element while said at least one wheel engages said underlying surface.

2. The base assembly of claim 1 wherein said mounting assembly is offset from the center of said support frame member in a direction toward a rear side of said support frame member and said at least one wheel is located adjacent a front side of said frame member.

3. The base assembly of claim 1 wherein said at least one wheel is a caster wheel.

4. The base assembly of claim 1 wherein said support frame member is attached to said hose reel enclosure utilizing fasteners.

5. The base assembly of claim 1 wherein said support frame member is in the form of a "X", each of the four ends of said support frame member being attachable to the hose reel enclosure proximate a corner of the hose reel enclosure.

6. The base assembly of claim 1 wherein said support frame member is releasably attached to said hose reel enclosure.

7. The base assembly of claim 6 wherein end portions of said support frame member include clips thereon; said clips engaging the lowermost portions of the hose reel enclosure thereby securing said support frame member to the hose reel enclosure and together with said securing element supporting the hose reel enclosure above said underlying surface.

8. The base assembly of claim 7 wherein said clips are integrally formed on said support frame member end portions.

9. The base assembly of claim 1 wherein said support frame member is formed from the same material as said hose reel enclosure.

10. The base assembly of claim 1 wherein said support frame member comprises a plurality of extension members; said extension members connected to a central area and said extension members extending outwardly from said central area.

11. The base assembly of claim 10 wherein said support frame member is releasably attached to said hose reel enclosure.

12. The base assembly of claim 11 wherein said extension members include clips on end portions of said extension members; said clips engaging the lowermost portions of the hose reel enclosure thereby securing said support frame member to the hose reel enclosure and together with said securing element supporting the hose reel enclosure above said underlying surface.

13. The base assembly of claim 10 wherein said extension members are substantially channel shaped in cross section.

14. The base assembly of claim 10 wherein said mounting assembly is a substantially cylindrical element; said extension members being attached to an exterior surface of said mounting assembly and extending outwardly from said mounting assembly.

15. An assembly for attachment to a hose reel enclosure to enable movement of the hose reel enclosure, said assembly comprising;

a plurality of wheels operatively connected to a lower portion of said hose reel enclosure adjacent a front portion thereof;

a support member operatively connected to a lower portion of said hose reel enclosure adjacent a rear portion thereof;

a securing element pivotally secured to said support member and being attachable to an underlying surface, said assembly and said hose reel enclosure pivotally move about said securing element while said plurality of wheels engage said underlying surface.

* * * * *